US008517366B2

(12) United States Patent
Seber et al.

(10) Patent No.: US 8,517,366 B2
(45) Date of Patent: Aug. 27, 2013

(54) QUICK RELEASE BENCH VISE SYSTEM

(75) Inventors: Brett P. Seber, Vista, CA (US); Wesley James Tom, Escondido, CA (US)

(73) Assignee: Seber Design Group, Inc., Vista, CA (US)

( * ) Notice: Subject to any disclaimer, the term of this patent is extended or adjusted under 35 U.S.C. 154(b) by 121 days.

(21) Appl. No.: 12/620,753

(22) Filed: Nov. 18, 2009

(65) Prior Publication Data

US 2011/0001283 A1 Jan. 6, 2011

Related U.S. Application Data

(60) Provisional application No. 61/118,320, filed on Nov. 26, 2008.

(51) Int. Cl.
*B25B 1/02* (2006.01)
*B25B 5/02* (2006.01)

(52) U.S. Cl.
USPC ..... 269/173; 269/181; 269/182; 269/172

(58) Field of Classification Search
USPC ..... 269/173, 172, 208, 247, 157, 212, 269/43, 181, 179, 246, 244, 153
See application file for complete search history.

(56) References Cited

U.S. PATENT DOCUMENTS

| | | | | |
|---|---|---|---|---|
| 1,452,384 | A * | 4/1923 | Kissendorfer | 269/182 |
| 4,262,892 | A * | 4/1981 | Wu | 269/181 |
| 4,569,510 | A * | 2/1986 | Haramoto | 269/181 |
| 4,809,962 | A * | 3/1989 | Lee | 269/182 |
| 5,124,533 | A * | 6/1992 | Dommer et al. | 219/243 |
| 5,531,428 | A * | 7/1996 | Dembicks et al. | 269/172 |
| 5,941,152 | A | 8/1999 | Kim | |
| 6,619,644 | B1 * | 9/2003 | Liou | 269/185 |
| 7,673,861 | B2 | 3/2010 | Meholovitch et al. | |

FOREIGN PATENT DOCUMENTS

| | | |
|---|---|---|
| AU | 6708474 A | 9/1975 |
| GB | 4653 | 0/1913 |

OTHER PUBLICATIONS

EPO Supplementary European Search Report dated Mar. 6, 2013, European Patent Application No. 09829713.8.

* cited by examiner

*Primary Examiner* — Lee D Wilson
*Assistant Examiner* — Seahee Yoon
(74) *Attorney, Agent, or Firm* — Patterson & Sheridan, LLP

(57) ABSTRACT

A quick release vise includes a first and second jaw moveable relative to the first jaw, and a threaded shaft rotatably fixed to the second jaw. A shaft receiver is fixed relative to the first jaw and includes a boss and a boss cover that is moveable relative to the boss. The boss and the boss cover have channels which cooperatively define an at least partially threaded shaft-receiving bore. The boss cover is moveable between a first position wherein the threads of the shaft engage threads within the shaft-receiving bore, and a second position wherein the threads of the shaft are disengaged from the threads within the shaft-receiving bore.

20 Claims, 5 Drawing Sheets

QUICK RELEASE BENCH VISE SYSTEM

BACKGROUND OF THE INVENTION

The present invention is generally directed to vises for holding work pieces. More particularly, the present invention is directed to a quick release mechanism for a vise which allows fast and easy movement of a vise clamping jaw.

Vises have been known in the art as a common mechanism for holding a work piece in a stationary position while the work piece is being worked on, treated or repaired. Typically, a work piece to be held in the vise is placed between a pair of jaws, wherein one of the jaws is stationary and the other jaw is movable relative to the stationary jaw so as to tighten the jaws around the work piece.

An operator controls movement of the jaws by rotating a handle that is attached to a threaded shaft mechanically coupling the two jaws. Rotation of the handle results in incremental, linear movement of one of the jaws toward or away from the other jaw. It can be time consuming and tedious to achieve a great amount of movement of the jaws relative to one another. This is especially so, considering how many times a day a vise may be used to hold differently sized work pieces.

Accordingly, there is a need for a quick release vise that permits quick and easy movement of one of the jaws relative to the other jaw while still permitting controlled, incremental movement, such as via a threaded shaft. The present invention fulfills these needs and provides other related advantages.

SUMMARY OF THE INVENTION

The quick release vise of the present invention includes a first jaw and a second jaw that is moveable relative to the first jaw. A threaded shaft is rotatably fixed to the second jaw. A shaft receiver is fixed relative to the first jaw and includes a boss and a boss cover that is moveable relative to the boss. The boss has a first channel and the boss cover has a second channel which cooperatively define an at least partially threaded shaft-receiving bore.

The second channel includes a threaded surface for engaging the threaded shaft, and the first channel includes a smooth surface to allow the threaded shaft to easily slide past. The boss cover is pivotable relative to the boss between a first and second position. In the first position the threads of the shaft engage the threads within the shaft-receiving bore. In the second position the threads of the shaft are disengaged from the threads within the shaft-receiving bore so that the second jaw can slide relative to the first jaw without rotation of the threaded shaft.

The boss cover is biased toward the first position through the use of a spring. This allows the first position to be the default position where the threads of the shaft are engaged with the threads of the receiver. The spring may extend from the boss cover to the boss.

An actuator is used for selectively moving the boss cover from the first position to the second position. The actuator includes a pin that engages the boss cover. The pin is slidable relative to the first jaw and includes a button on the outside which can be pressed by the user. The pin is biased away from engagement with the boss cover by means of a spring such that the default position is in the first position. The pin is selectively moveable into engagement with the boss cover when the second position is desired to allow the second jaw to quickly slide relative to the first.

In a preferred embodiment, the second jaw has a long extension, such as an arm, that slides relative to the first jaw and extends through the first jaw. The arm of the second jaw and the threaded shaft are substantially coextensive as they both extend through the first jaw. The shaft receiver is positioned within the first jaw and further within the arm of the second jaw so that the arm slides past the receiver. The arm has a slot coextensive with the threaded shaft such that the pin is selectively movable into engagement with the boss cover through the slot. Furthermore, the boss cover has a chamfered or angled surface wherein the pin engages with the chamfered surface to pivot the boss cover in the second position.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
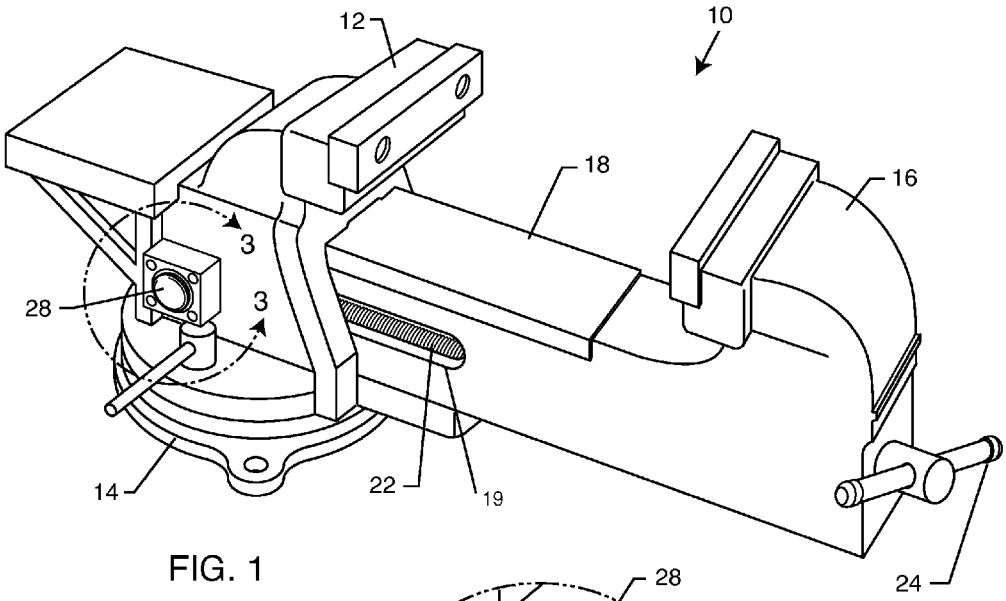
FIG. 1 is a perspective view of an exemplary quick release bench vise embodying the present invention.

FIG. 1 illustrates a perspective view of an exemplary quick release bench vise 10 which embodies the present invention. The vise 10 includes a first jaw 12 which can be fastened to a work bench or table through its flat base 14 using screws, bolts, C-clamps, or any other suitable fastening technique. As with most bench vises, the first jaw 12 can also be rotated and locked into place using conventional methods. A second jaw 16 is moveable relative to the first jaw 12. In this embodiment, the second jaw 16 has an elongated arm 18 which translates within a passageway 20 through the first jaw 12, allowing the jaws to come together to hold a work piece therebetween. The arm 18 also includes a slot 19 in at least one side.

Rotatably fixed to the second jaw 16 is a threaded shaft 22. The threaded shaft 22 is parallel to the elongated arm 18 and also resides within the passageway 20 of the first jaw 12. The threaded shaft 22 may be rotated with a traditional handle 24 attached to the threaded shaft 22 on an end extending from second jaw 16. The threaded shaft 22 may be fully or partially threaded along its length. Furthermore, the threaded shaft 22 may be comprised of varying types of thread and helical structures suitable for converting rotational movement into linear movement. This disclosure is not intended to limit to any one specific type.

Figure 2:
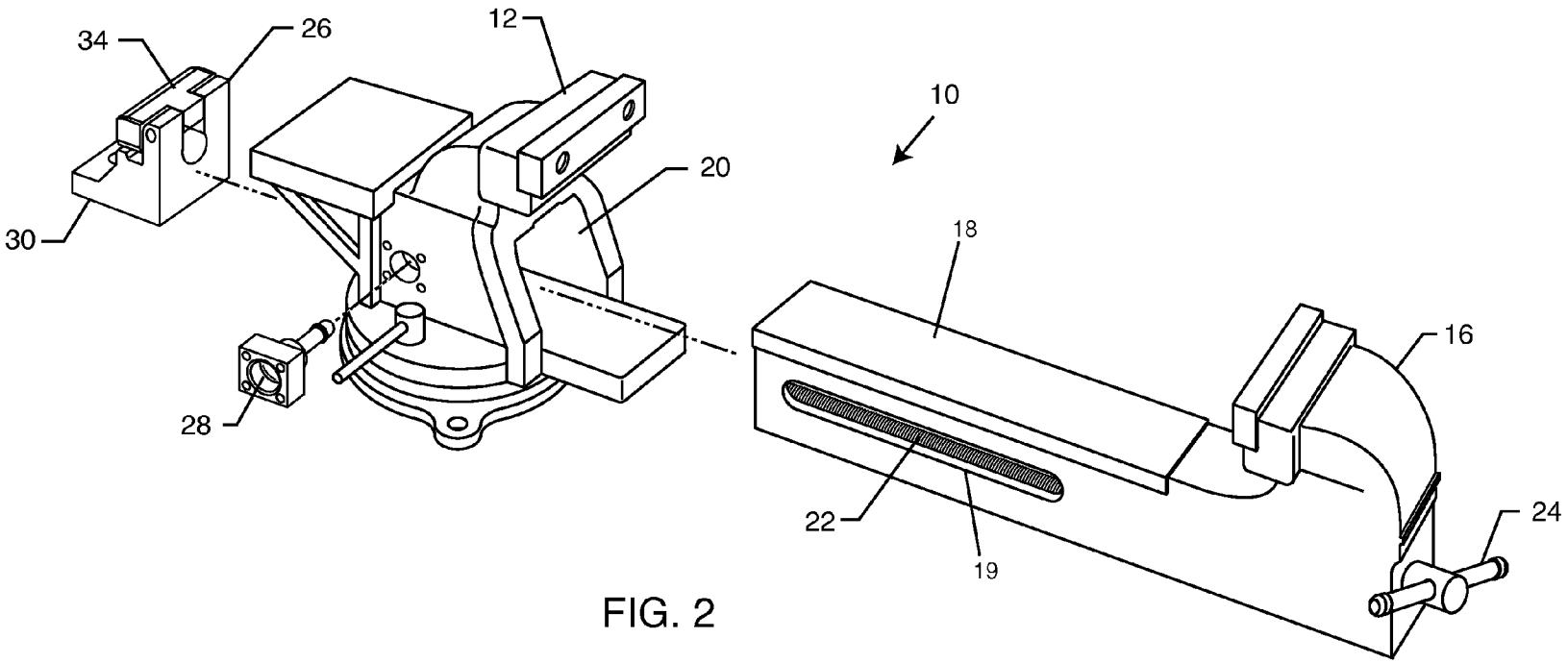
FIG. 2 is an exploded perspective view of the quick release bench vise of FIG. 1.

FIG. 2 is an exploded view of the quick release bench vise 10 of FIG. 1. A shaft receiver 26 can be seen which is located within the passageway 20 of the first jaw 12. The shaft receiver 26 is fixed relative to the first jaw 12 through any suitable means, or may even be formed as an integral part of the first jaw 12. The threaded shaft 22 mechanically engages the shaft receiver 26 to transform the rotational movement of the threaded shaft 22 into linear movement of the second jaw 16 relative to the first jaw 12. When the jaws come together, they can then hold a work piece in position so that a user can perform some form of work, be it cutting, machining, sawing or the like.

Figure 3:
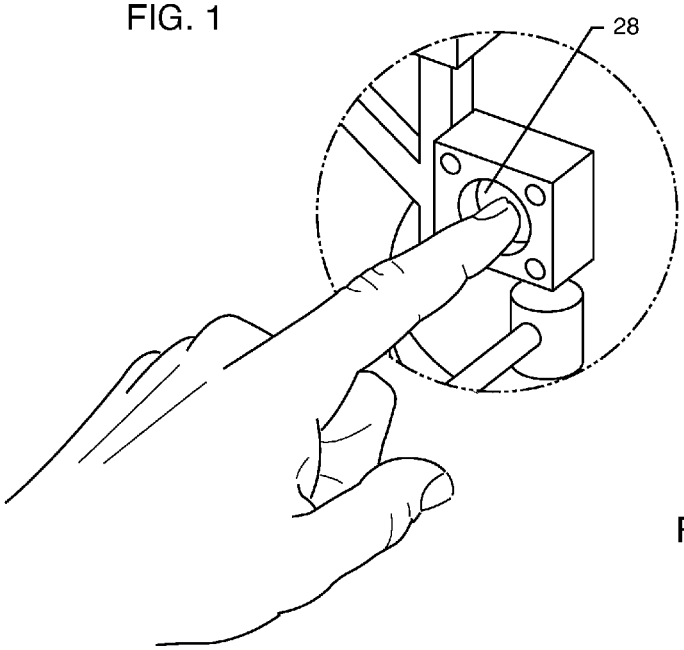
FIG. 3 is an enlarged view of the actuator of FIG. 1 taken generally of the area indicated by the line 3-3.

To engage and disengage the shaft receiver 26 from the threaded shaft 22, an actuator 28 is used. FIG. 3 illustrates a close-up view of the actuator 28. The actuator 28 may be pressed by the user to disengage the shaft receiver 26. The actuator 28 is preferably mounted and accessible from the outside of the first jaw 12. This placement allows easy access to the actuator 28.

Figure 4:
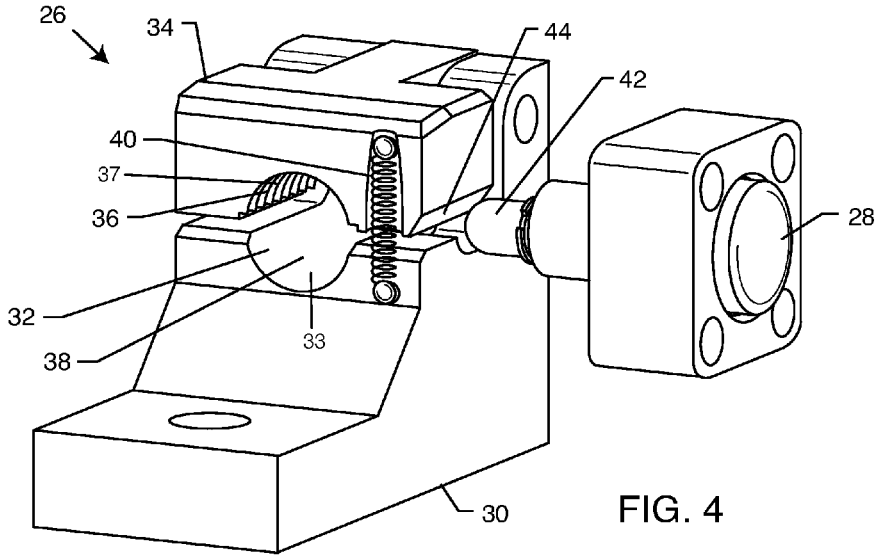
FIG. 4 is a perspective view of a shaft receiver and actuator.
Figure 5:
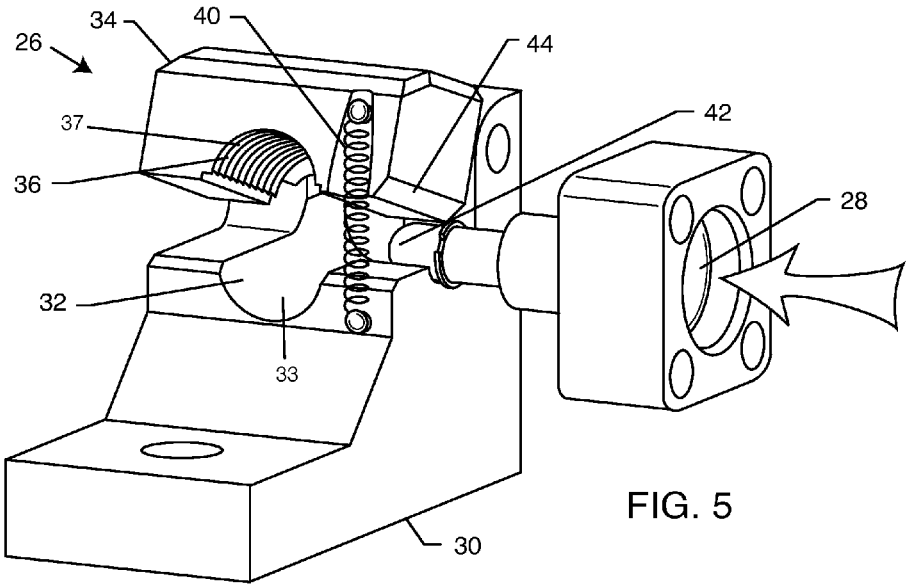
FIG. 5 is a view similar to FIG. 4, showing the shaft receiver in a released state.
Figure 6:
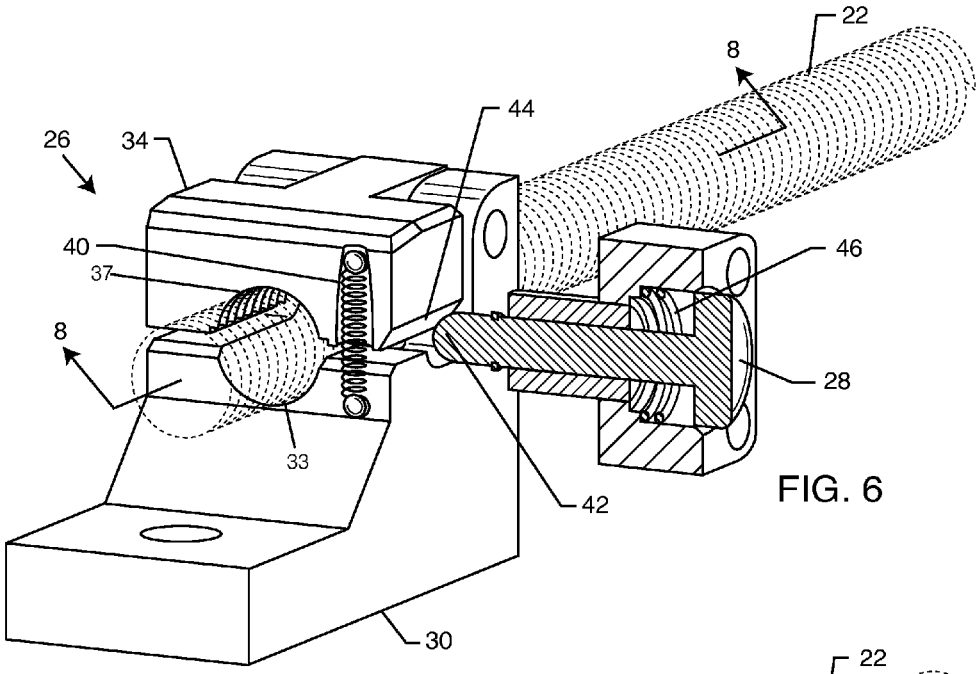
FIG. 6 is a partially sectional view of the structure of FIG. 4, with shaft shown.
Figure 7:
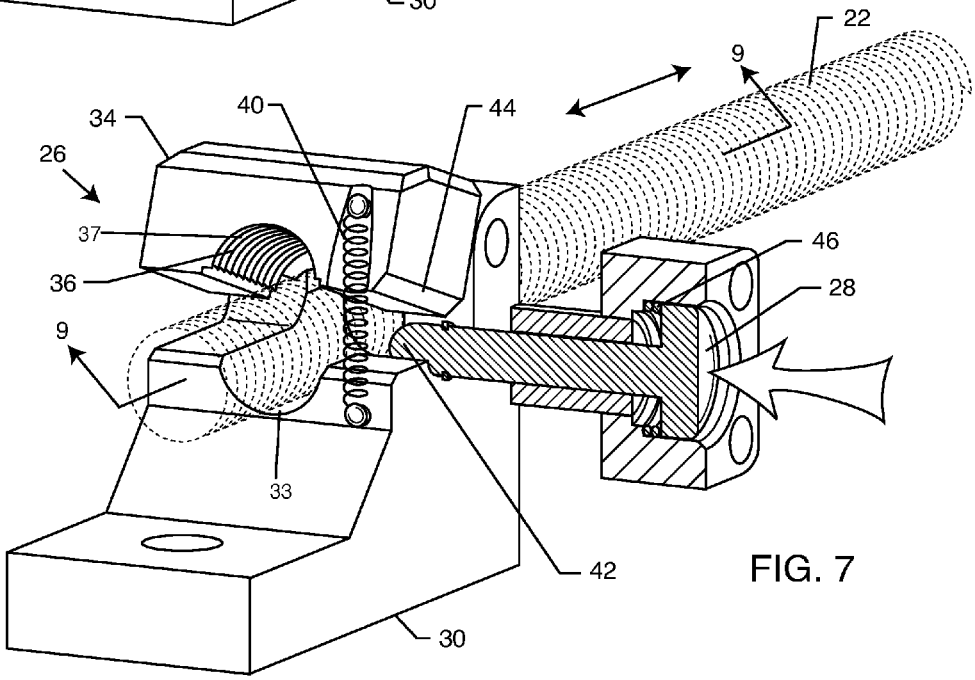
FIG. 7 is a partially sectional view of the structure of FIG. 5, with shaft shown.
Figure 8:
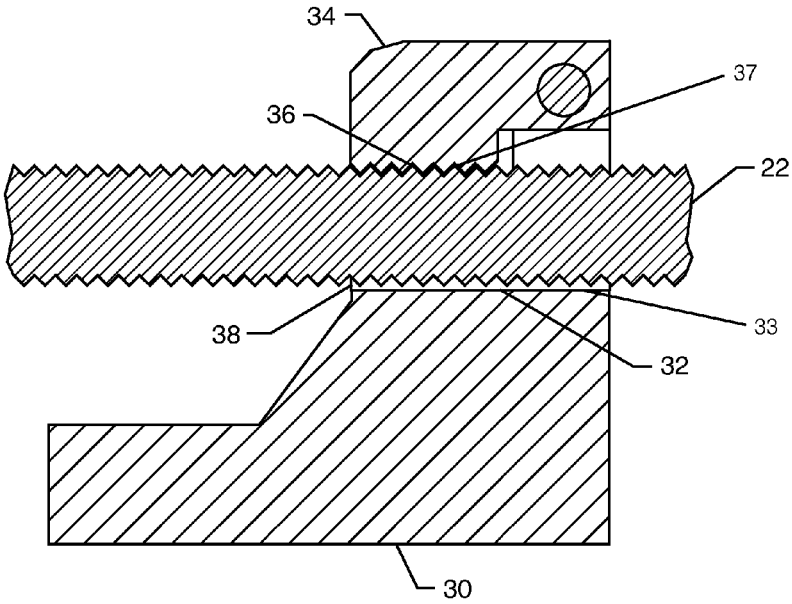
FIG. 8 is an enlarged sectional view taken along line 8-8 of FIG. 6.

The operation of the actuator 28 and the shaft receiver 26 will be understood with reference to FIGS. 4-9, wherein the vise 10 has been removed for better illustration of the operation of the quick release mechanism while keeping the relative positioning of the shaft receiver 26 to the actuator 28. However, it is understood that the actuator 28 is inserted through a side of the first jaw 12, and through the slot 19 in the arm 18, as shown in FIG. 1. Referring to FIGS. 4, 6, and 8, boss 30 is fixed relative to the first jaw 12. The boss 30 may be attached to the first jaw 12 by any suitable means, or even formed as an integral part thereof. The boss 30 has a first channel 32 which has a relatively smooth and featureless surface 33, meaning it has no threaded portion along its length. The first channel 32 is incapable of mechanically engaging the threaded shaft 22, and allows the threaded shaft 22 to slide within it unrestricted. Moveably attached to the boss 30 is a boss cover 34 which defines a second channel 36 that includes a threaded surface 37 to match the surface of the threaded shaft 22. The first channel 32 and second channel 36 cooperate to form a bore 40 for the threaded shaft 22 to pass therethrough. In this embodiment, the boss cover 34 is pivotably connected to the boss 30. However, it should be appreciated that a range of moveable connections could be envisioned to move the boss cover 34 toward and away from the threaded shaft 22.

The boss cover 34 is biased towards the boss 30 with a spring 40 as shown, or any other suitable method, including but not limited to magnetism, locks and gears. The spring 40 forces the boss cover 34 to pivot into contact with the boss 30 when in the default or engaged state. In the default state, the threads of the boss cover 34 engaged the threads of the threaded shaft 22. Rotation of the threaded shaft 22 causes linear translation of the second jaw 16.

Figure 9:
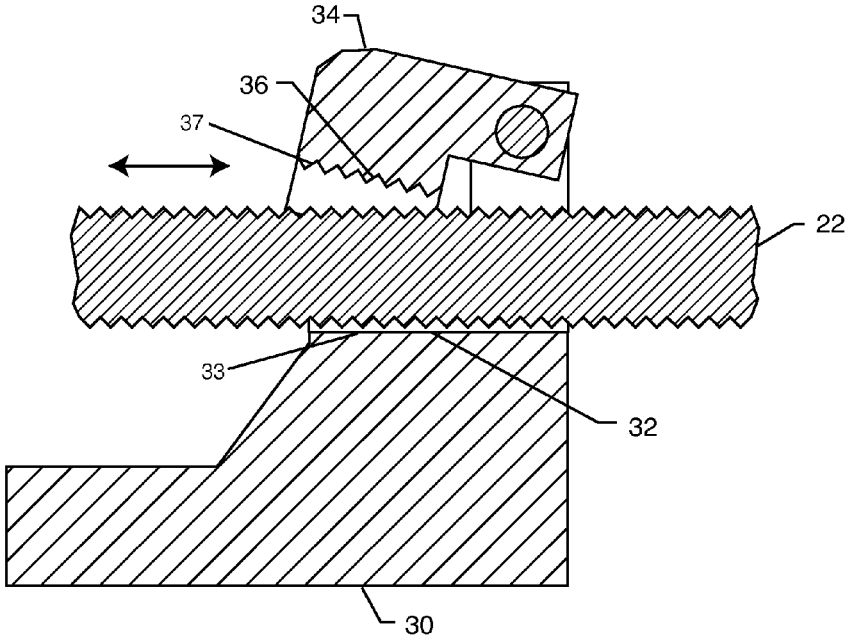
FIG. 9 is an enlarged sectional view taken along line 9-9 of FIG. 7.

Referring to FIGS. 5, 7 and 9, the distal end of the actuator 28 has a pin 42 which has contacted the boss cover 34. The boss cover 34 has a chamfer 44 along the end directly in front of the pin 42. The actuator 28 is in a default state when it is not contact with the boss cover 34 due to the bias element as shown in FIGS. 4, 6 and 8. Here, a compression spring 46 forces the actuator 28 and pin 42 away from the boss cover 34. However, as shown in FIGS. 5, 7 and 9, when a user presses on the actuator 28 and overcomes the force of the compression spring 46, the pin 42 is forced into contact with the chamfer 44. The chamfer 44 then allows the translational movement of the pin 30, to then pivot the boss cover 34 away from the boss 30. In FIG. 5, the shaft receiver is in the disengaged state where the threads of the second channel 36 are not in mechanical engagement with the threaded shaft 22. Once the user releases the actuator 28, the compression spring 46 will move the pin 42 away from the boss cover 34, and the boss cover 34 will pivot back into contact with the boss 30 due to the spring 40. It is to be appreciated that the chamfer 44 may be formed in a multitude of surface configurations suitable to cause the boss cover 34 to pivot away from the boss 30, and this disclosure is not limited to the specific form described herein.

It should be appreciated that the quick release bench vise 10 described herein is exemplary and that variations are possible. For example, the boss cover 34 does not have to move relative to the boss 30. Rather, any type of relative movement between the boss cover 34 and the boss 30 is possible. Moreover, the movement between the boss cover 34 and boss 30 does not have to be a pivoting movement but can be a linear or a curvilinear movement. Also, the boss 30 and boss cover 34 can be replaced with side members or various quantities of members that are configured to achieve a released and engaged state with the threaded shaft 22. It should also be appreciated that the actuator 28 is exemplary and that other actuation mechanisms can be used to transition the quick release bench vise 10 from an engaged state to a disengaged state.

In normal operation, the shaft receiver 26 is in the engaged state, which means that the threads of the threaded shaft 22 are engaged with the threads of the second channel 36 (See FIGS. 4, 6 and 8). A user can cause the second jaw 16 to move toward the first jaw 12 in a conventional manner by rotating the handle 38, which causes rotation and longitudinal advancement of the threaded shaft 22 through the shaft receiver 26. The threaded shaft 22 is operatively connected to the second jaw 16 such that longitudinal advancement of the threaded shaft 22 through the shaft receiver 26 causes the second jaw 16 to move toward the first jaw 12 to thereby effect vise jaw closure about a work piece to be held. The amount of linear movement of the second jaw 16 per rotation of the threaded shaft 22 is determined by the thread size. In general, the linear movement is incremental to permit incremental closure of the jaws relative to one another.

In certain situations, it may be desirable to achieve a relatively quick and large movement of the second jaw 16 relative to the first jaw 12. If such movement is desired, the user can actuate the quick release bench vise 10 to move it to the released state as shown in FIGS. 5, 7 and 9, such that the threaded shaft 22 is no longer engaged with the threads of the second channel 36 in the boss cover 34. The boss cover 34 is actuated by depressing the actuator 28 to move the pin 42 into contact with the chamfer 44. This permits the threaded shaft 22 and the second jaw 16 to slide freely relative to the first jaw 12. When the user releases the actuator 28, the quick release bench vise 10 returns to the engaged state.

Although a preferred embodiment has been described in detail for purposes of illustration, various modifications may be made without departing from the scope and spirit of the invention. Accordingly, the invention is not to be limited, except as by the appended claims.

What is claimed is:

1. A quick release vise, comprising:

a first jaw;

a second jaw laterally moveable relative to the first jaw;

a threaded shaft rotatably fixed to the second jaw; and a shaft receiver laterally fixed relative to the first jaw, the shaft receiver comprising a boss defining a non-threaded first channel, and a boss cover moveable relative to the boss and defining a threaded second channel, wherein the channels cooperatively define an at least partially threaded shaft-receiving bore, and wherein the non-threaded first channel supports the shaft when the boss cover is in an open position.

2. The quick release vise of claim 1, wherein the boss cover is pivotable relative to the boss between a first position wherein threads of the shaft engage threads within the shaft-receiving bore, and a second position wherein the threads of the shaft disengage from the threads within the shaft-receiving bore.

3. The quick release vise of claim 2, wherein the boss cover is biased toward the first position.

4. The quick release vise of claim 3, including a spring for biasing the boss cover toward the first position.

5. The quick release vise of claim 4, wherein the spring extends from the boss cover to the boss.

6. The quick release vise of claim 3, including an actuator for selectively moving the boss cover from the first position to the second position.

7. The quick release vise of claim 6, wherein the actuator comprises a pin that engages the boss cover.

8. The quick release vise of claim 7, wherein the pin is slidably supported by the first jaw.

9. The quick release vise of claim 8, wherein the pin is biased away from engagement with the boss cover, but is selectively moveable into engagement with the boss cover.

10. The quick release vise of claim 9, including a spring for biasing the pin away from engagement with the boss cover.

11. The quick release vise of claim 1, wherein the second jaw includes an arm that slidably extends through the first jaw.

12. The quick release vise of claim 11, wherein the threaded shaft is substantially coextensive with the arm of the second jaw.

13. The quick release vise of claim 11, wherein the shaft receiver is attached to the first jaw.

14. The quick release vise of claim 11, wherein the arm slides past the shaft receiver.

15. The quick release vise of claim 14, wherein the shaft receiver is substantially positioned within the arm, and wherein the arm is disposed substantially within the first jaw.

16. The quick release vise of claim 15, including a pin slidable relative to the first jaw, wherein the arm comprises a slot and the pin is selectively movable into engagement with the boss cover through the slot.

17. The quick release vise of claim 16, including a button fixed relative to the pin, wherein the button is positioned outside the first jaw.

18. The quick release vise of claim 16, wherein the boss cover comprises a chamfer, and the pin is selectively moveable into engagement with the chamfer.

19. The quick release vise of claim 1, wherein, when the boss cover is in a closed position, the shaft receiver is configured to transform a rotational movement of the threaded shaft into a linear movement of the second jaw relative to the first jaw.

20. The quick release vise of claim 1, wherein the boss cover is pivotable relative to the first jaw and the boss is non-pivotable relative to the first jaw.

* * * * *